US006151751A

United States Patent [19]

McCormick et al.

[11] Patent Number: 6,151,751

[45] Date of Patent: Nov. 28, 2000

[54] VACUUM CLEANER WITH DUST BAG RETENTION FLAPS

[75] Inventors: Michael J. McCormick, Danville; Yuichi Schimizu, Lexington, both of Ky.

[73] Assignee: Matsushita Electric Corporation of America, Danville, Ky.

[21] Appl. No.: 09/297,806

[22] PCT Filed: Jul. 22, 1998

[86] PCT No.: PCT/US98/15186

§ 371 Date: May 5, 1999

§ 102(e) Date: May 5, 1999

[87] PCT Pub. No.: WO00/04813

PCT Pub. Date: Feb. 3, 2000

[51] Int. Cl.[7] ..... A47L 9/14

[52] U.S. Cl. ..... 15/351; 15/339; 55/DIG. 3

[58] Field of Search ..... 15/347, 350, 351, 15/352, 327.2; 55/359, DIG. 3

[56] References Cited

U.S. PATENT DOCUMENTS

| | | | |
|---|---|---|---|
| 2,779,432 | 1/1957 | Meyerhoefer . | |
| 3,238,706 | 3/1966 | Kurlinski . | |
| 3,634,905 | 1/1972 | Boyd . | |
| 3,763,635 | 10/1973 | Schmitz | 15/351 X |
| 4,193,844 | 3/1980 | Neumann et al. . | |
| 4,257,789 | 3/1981 | Leinfelt . | |
| 4,512,057 | 4/1985 | Laing et al. . | |
| 4,670,937 | 6/1987 | Sumerau et al. . | |
| 4,705,547 | 11/1987 | Rotola et al. . | |
| 4,738,697 | 4/1988 | Westergren . | |
| 4,745,654 | 5/1988 | Yamamoto et al. | 15/347 X |
| 4,885,013 | 12/1989 | Ahlf et al. . | |
| 5,390,392 | 2/1995 | Thomas et al. . | |
| 5,755,009 | 5/1998 | Stephens et al. | 15/347 |
| 5,961,676 | 10/1999 | King et al. | 15/347 X |

FOREIGN PATENT DOCUMENTS

| | | |
|---|---|---|
| 322 387 | 6/1989 | European Pat. Off. . |

*Primary Examiner*—Chris K. Moore
*Attorney, Agent, or Firm*—King and Schickli, PLLC

[57] ABSTRACT

A vacuum cleaner is provided including a nozzle assembly, an agitator brush mounted for relative rotation on the nozzle assembly, a motor and fan assembly carried on the vacuum cleaner and a handle and canister assembly pivotally mounted to the nozzle assembly. The handle and canister assembly includes a cavity for holding a dust bag, a removable access door for accessing the cavity and a retention flap across the corner of the access opening for engaging and retaining the dust bag fully in the cavity when the access door is installed following dust bag replacement. Preferably, one retention flap is provided at each corner of the access opening.

8 Claims, 4 Drawing Sheets

18
20
16
10
48
50
44
36
12
34
30
28
32
24
22
14
26
38
42
40

VACUUM CLEANER WITH DUST BAG RETENTION FLAPS

TECHNICAL FIELD

The present invention relates generally to the vacuum cleaner art and, more particularly to a unique structural arrangement for better retaining a dust bag within the cavity of the handle and canister assembly of the vacuum cleaner during reinstallation of the access door following dust bag replacement.

BACKGROUND OF THE INVENTION

A vacuum cleaner is an electrically powered, mechanical appliance utilized for the dry removal of dust, loose dirt and debris from carpets, rugs, fabrics and other surfaces. Vacuum cleaners have been widely utilized for years in domestic and industrial cleaning applications.

In operation, a pressure drop is utilized to force air entrained with dust, loose dirt and debris into the nozzle of the vacuum cleaner. A dust bag is provided in a cavity of the handle and canister assembly of the vacuum cleaner. The dirt and dust laden air is drawn through this bag which traps and retains the dirt. The air is then exhausted by a electric fan through an additional filter to remove relatively fine particles. It is this fan that provides the air pressure drop or vacuum that furnishes the cleaning action.

Of course, it should be appreciated that the dust bag periodically becomes full and thus requires changing. Toward this end, an access door is provided on the handle and canister assembly. The access door is removed exposing an access opening. The dust bag is then carefully removed from the cavity through the access opening for disposal. A new dust bag is then positioned in the cavity with the inlet opening of the bag placed over the air stream conduit leading from the nozzle assembly. The access door is then replaced to close the access opening.

Typically, new dust bags are sold in packages of three or more. The dust bags are typically paper products that have been folded and creased for packaging in order to assume a minimal volume. When inserted in the cavity of the handle and canister assembly, the folds and creases previously assumed for packaging purposes often have a tendency to cause the dust bag to protrude from the cavity and interfere with replacement or reinstallation of the access door. Not only is this inconvenient, but in many cases, a portion of the dust bag is inadvertently pinched between the access door and the sidewalls of the handle and canister assembly when the access door is replaced. This may compromise the seal formed between the access door and the housing of the handle and canister assembly and as a result cause some air to be drawn by the fan and motor assembly around the access door rather than through the nozzle. Thus, a loss of cleaning efficiency may result. Further, capture of even the smallest portion of the dust bag in the access door may prevent the bag from expanding properly. Thus, improper filling of the dust bag including a loss of capacity or in extreme cases the inadvertent uncoupling of the bag opening from the air path leading to the nozzle assembly may result. Accordingly, a need is identified for a way to retain the dust bag in its proper position within the cavity of the handle and canister assembly during the process of replacing the access door.

SUMMARY OF THE INVENTION

Accordingly, it is a primary object of the present invention to provide a vacuum cleaner and particularly an upright vacuum cleaner overcoming the above described disadvantages of prior art vacuum cleaners.

Still another object of the present invention is to provide an upright vacuum cleaner including a relatively simple and inexpensive structural arrangement that more reliably retains a dust bag fully within the cavity of the handle and canister assembly so as to prevent any interference between the dust bag and access door as that access door is reinstalled to close the canister and handle assembly and seal the dust bag in the cavity.

Additional objects, advantages and other novel features of the invention will be set forth in part in the description that follows and in part will become apparent to those skilled in the art upon examination of the following or may be learned with the practice of the invention. The objects and advantages of the invention may be realized and obtained by means of the instrumentalities and combinations particularly pointed out in the appended claims.

To achieve the foregoing and other objects, and in accordance with the purposes of the present invention as described herein, a vacuum cleaner is provided with a simple but unique convenience feature. The vacuum cleaner includes a nozzle assembly. An agitator brush is mounted for relative rotation on the nozzle assembly. A motor and fan assembly is carried on the vacuum cleaner and provides the air pressure drop or suction for moving the dirt laden air.

The vacuum cleaner also includes a handle and canister assembly that is pivotally mounted to the nozzle assembly. The handle and canister assembly includes a cavity for holding a dust bag as well as a removable access door for accessing the cavity. Advantageously, a retention flap is provided across a corner of the access opening. The retention flap engages a corner of the dust bag and thereby retains the dust bag fully within the cavity when the access door is installed following dust bag replacement.

More specifically describing the invention the handle and canister assembly includes two sidewalls, a bottom wall, a top wall and a back wall. A corner is formed at the intersection of each sidewall with the bottom and top walls. Accordingly, the access opening includes four corners. Preferably a retention flap is provided bridging between the sidewalls and the bottom and top walls at each corner. Together, each retention flap, the adjacent side and top/bottom wall and the backwall define a bag retention channel. Preferably, each bag retention channel has a volume of at least 19,000 $mm^3$. Still more preferably, each bag retention channel has a volume of between substantially 18,000–20,000 $mm^3$ with each retention channel being a polyhedron having a substantially triangular shape. The access opening defined between the two sidewalls, the bottomwall, the top wall and the retention flaps preferably has an area of at least 72,000 $mm^2$ so as to allow plenty of clearance for inserting the dust bag into the cavity and placing or positioning the inlet opening of the bag over the conduit providing the air flow path leading from the nozzle assembly.

As the dust bag is positioned in the cavity, the corners of the dust bag are tucked into and received by the dust bag retention channels. Advantageously, these channels function to fully retain the dust bag in the cavity so that the access door may be subsequently reinstalled without interference. As a result, installation of the dust bag is made easier for the operator and the potential for inadvertently pinching at least a portion of the dust bag between the access door and the side, top or bottom walls of the handle and canister assembly is virtually eliminated.

Still other objects of the present invention will become apparent to those skilled in this art from the following description wherein there is shown and described a preferred embodiment of this invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawing incorporated in and forming a part of the specification, illustrates several aspects of the present invention and together with the description serves to explain the principles of the invention. In the drawing.

Reference will now be made in detail to the present preferred embodiment of the invention, an example of which is illustrated in the accompanying drawing.

DETAILED DESCRIPTION OF THE INVENTION

Figure 1:
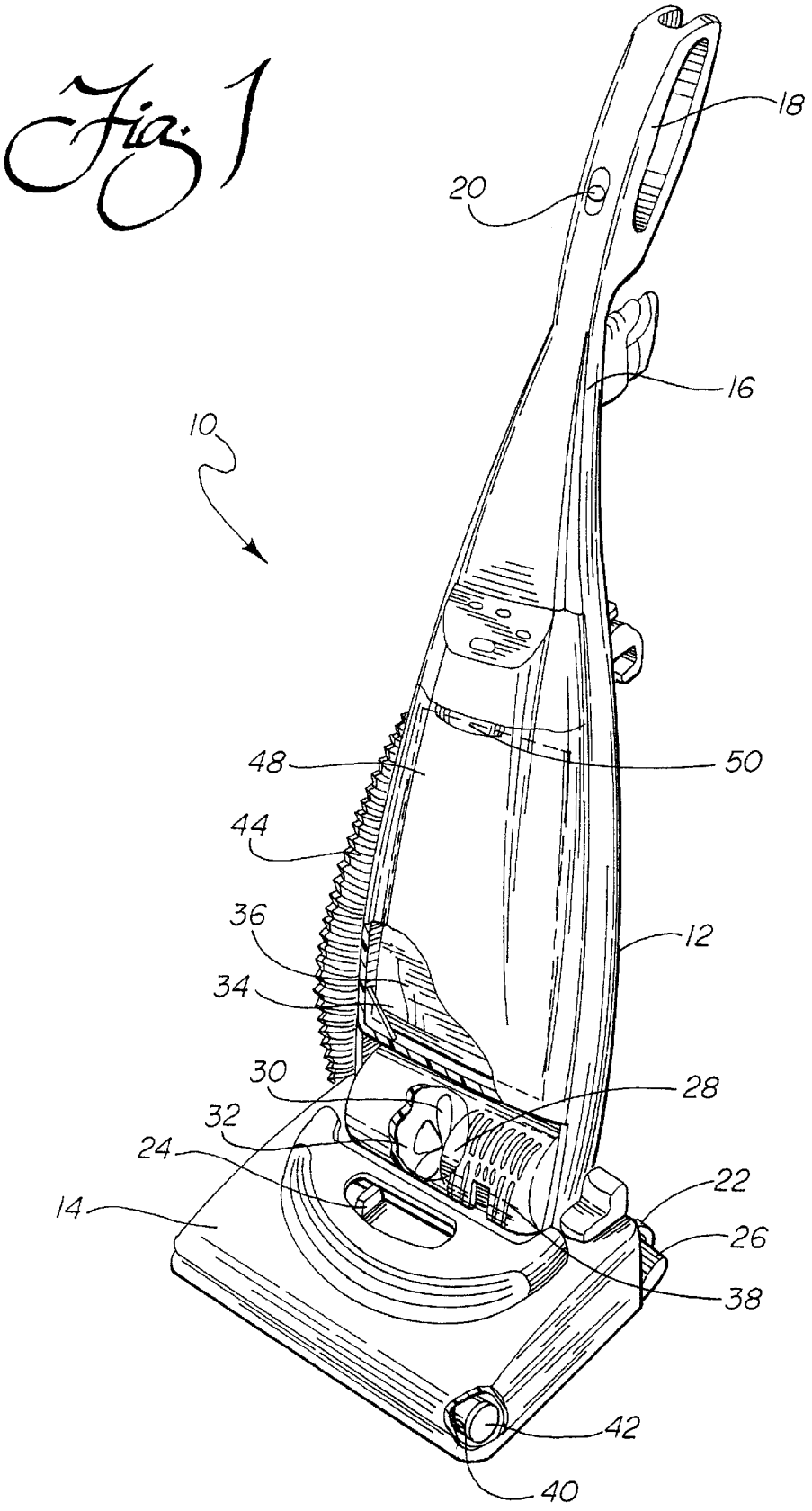
FIG. 1 is a perspective view of an upright vacuum cleaner illustrating the present invention.

Reference is now made to FIG. 1 showing a perspective view of the upright vacuum cleaner 10 constructed in accordance with the teachings of the present invention. The overall basic design of an upright vacuum cleaner is generally well known in the art. Specifically, the upright vacuum cleaner 10 includes a handle and canister assembly 12 that is pivotally connected to a nozzle assembly 14. A handle extension 16 is rigidly attached to the top of the handle and canister assembly 12. The handle extension 16 includes a hand grip 18 and a power switch 20 for turning the vacuum cleaner on and off. Of course, electrical power is supplied through a cord (not shown).

At the lower portion of the canister assembly 12, rear wheels 22 are provided to support the weight of the vacuum cleaner 10 and provide a pivot point about which the nozzle assembly 14 pivots when the height of the nozzle assembly is adjusted by manipulation of the height adjustment control 24. The operation of the height adjustment control 24 and its cooperating mechanism is described in detail in U.S. Pat. No. 5,467,502 to Johnson et al., the full disclosure of which is incorporated herein by reference. Of course, as is also known in the art, a foot latch 26 locks the handle and canister assembly 12 in an upright position as shown in FIG. 1 in order to allow storage and off the floor cleaning. When the foot latch 26 is released, the handle and canister assembly 12 may be pivoted relative to the nozzle assembly 14 in a manner well known in the art to allow manipulation of the vacuum cleaner during the cleaning operation.

Figure 2:
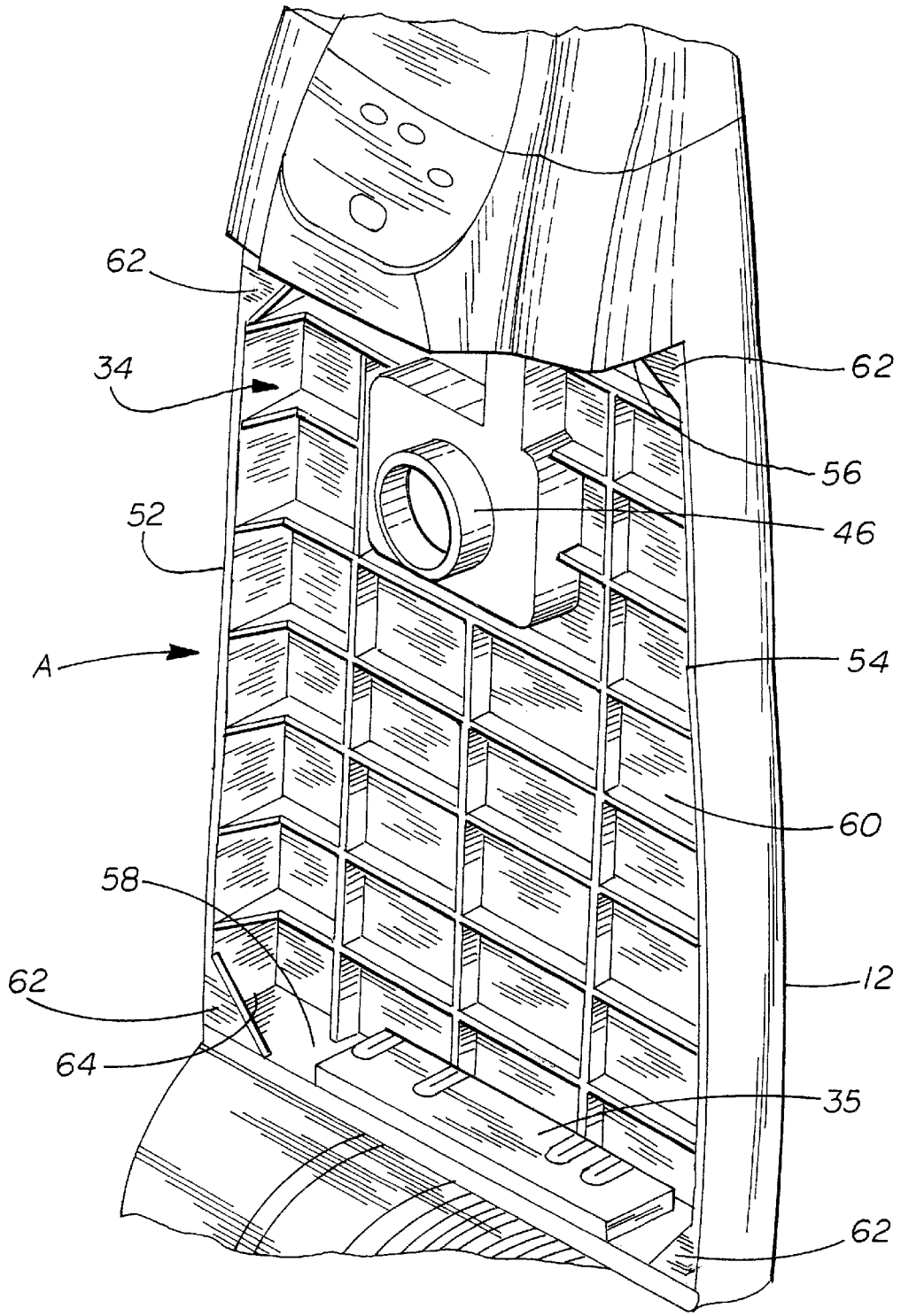
FIG. 2 is a detailed perspective view showing the handle and canister assembly with the access door and the dust bag removed thereby exposing the access opening, the dust bag retaining cavity and the retention flaps for holding a dust bag within the cavity.

As also shown in FIGS. 1 and 2, the handle and canister assembly 12 includes an internal chamber 32 which holds a motor 28 that drives a fan 30 which in turn generates a negative pressure or vacuum. The motor and fan assembly chamber 32 is provided in fluid communication by means of the opening (not shown) covered by filter 35 with a cavity 34 which receives and holds a dust bag 36. Specifically, the motor 30 and fan 32 cooperate to draw dust and dirt laden air into the cavity 34 and through the porous walls of the dust bag 36. The dust bag 36, of course, serves to trap suspended dirt and particles inside while allowing air to pass freely through for exhausting from the exhaust port 38.

The nozzle assembly 14 includes, at its front portion, a nozzle 40 that houses a rotating agitator brush 42. The agitator brush 42 is rotatively driven by the motor 30 through a drive transmission (not shown). As the agitator brush 42 is rotated, the brush functions to loosen trapped dirt and particulate matter in a carpeted floor surface. The negative pressure or vacuum suction created by the motor 30 and fan 32 then draw the air laden with this dirt and particulate matter from the nozzle 40 through the nozzle assembly 14, the hose 44 and the conduit 46 (see FIGS. 1 and 2). The inlet opening of the dust bag 36 is secured over the end of the conduit 46 and, accordingly, the air laden with dirt and particulate matter enters the dust bag. There, the dirt and particulate matter is trapped in the dust bag 36 in the manner described above and well known in the art.

The handle and canister assembly 12 also includes an access door 48 which may be removed by operation of the latch 50 in order to expose the cavity 34. More specifically, the handle and canister assembly 12 includes two sidewalls 52, 54, a top wall 56, a bottom wall 58 and a backwall 60. A corner is formed at the intersection of each sidewall 52, 54 with each top wall 56 and bottom wall 58. A triangular retention flap 62 is provided across each corner. Thus, an access opening A is defined by the sidewalls 52, 54, the top wall 56, the bottom wall 58 and the retention flaps 62. This access opening A allows one to install a dust bag 36 in the cavity 34 of the handle and canister assembly 12. Specifically, the dust bag inlet opening 63 is positioned over the end of the air path conduit 46 and the corners of the dust bag 36 are positioned so as to be received and held within the bag retention channels 64 defined at each corner by the retention flaps 62 and the adjacent sidewall 52 or 54, top or bottom wall 56, 58 and back wall 60. Preferably, each bag retention channel has a volume of at least 19,000 $mm^3$ and more preferably, a volume of between substantially 18,000–20,000 $mm^3$ in order to insure the necessary space to positively retain the corners of the dust bag 36 therein. Simultaneously, the access opening defined between the sidewalls 52, 54, top wall 56, bottom wall 58 and retention flaps 62 preferably has an area of at least 72,000 $mm^2$ to provide sufficient clearance to allow one to conveniently manipulate the opening of the dust bag 36 over the conduit 46 and position the dust bag in the cavity 34 with the corners held in the dust bag retention channels 64.

Figure 3:
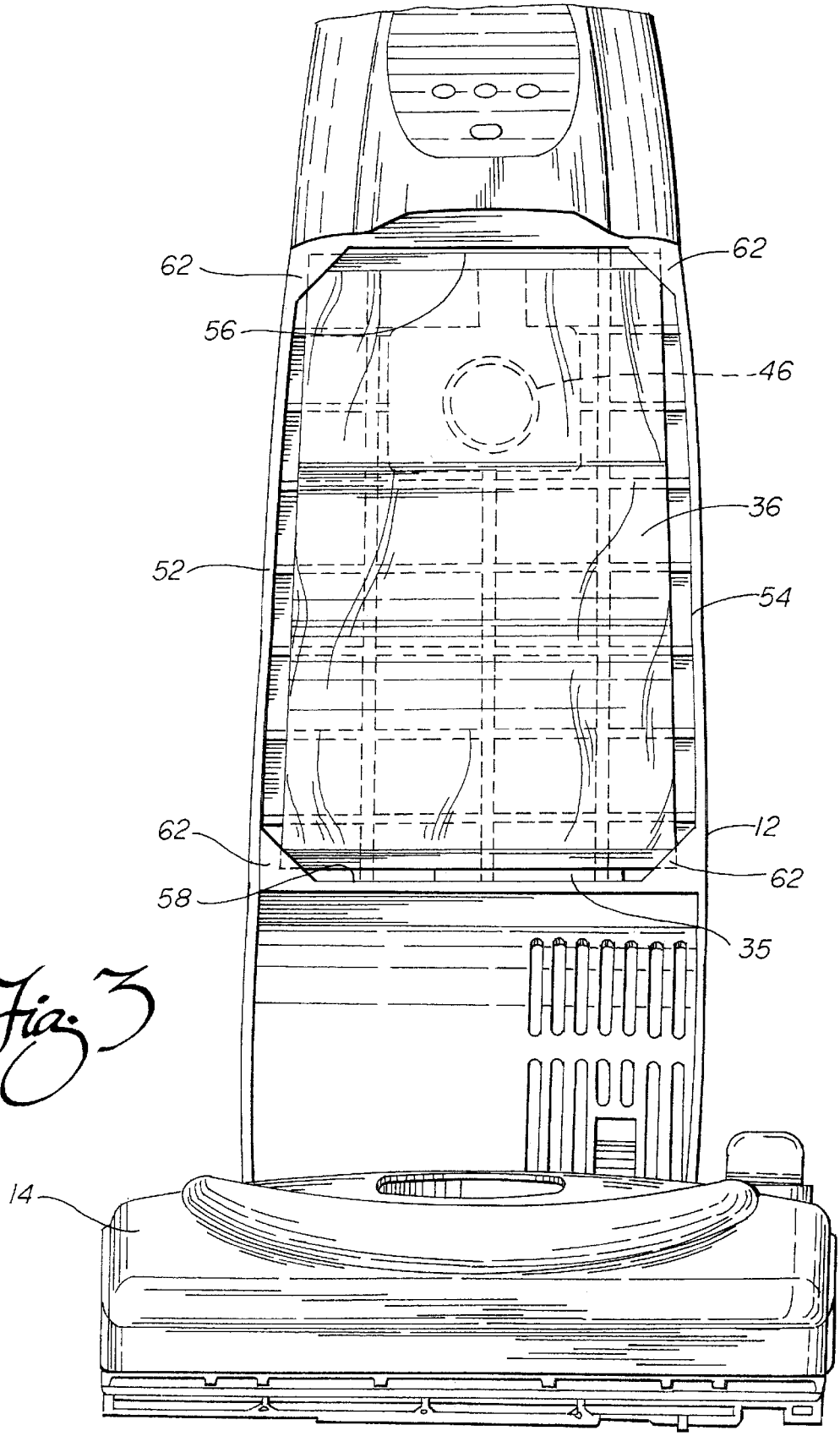
FIG. 3 is a detailed front elevational view showing how the corners of the dust bag are received and held in the bag retention channels behind the retention flaps so that the dust bag does not interfere with reinstallation of the access door.
Figure 4:
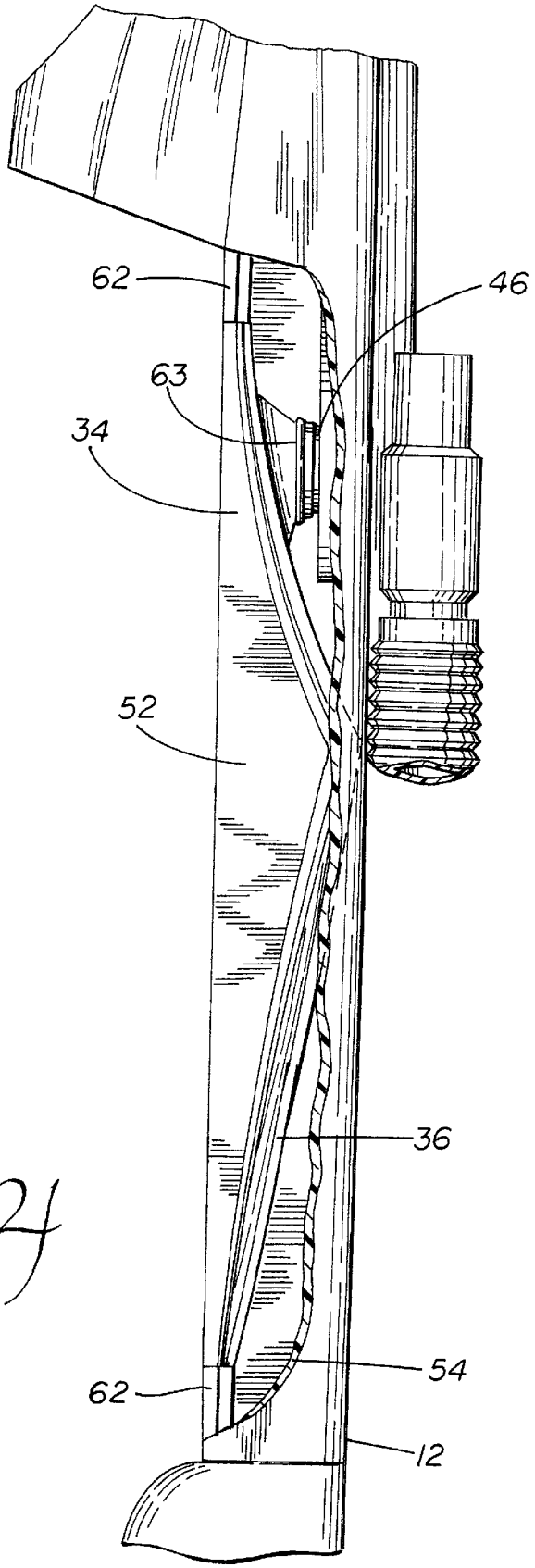
FIG. 4 is a detailed side elevational view showing how the retention flaps function to engage the corners of a new bag to hold the bag fully within the bag cavity despite the presence of packaging folds and creases.

When the dust bag 36 is fully positioned in the cavity 34, the retention flaps 62 engage and fully retain the bag in the cavity 34 behind the access opening defined by the outer exposed edges of the sidewalls 52, 54, the top wall 56 and the bottom wall 58 (see FIGS. 2 and 3). Accordingly, the dust bag 36 does not interfere with the installation of the access door 48. Accordingly, that door 48 may be easily replaced and latched in position to seal the dust bag 36 in the cavity 34 in the handle and canister assembly 12. Any potential for any portion of the dust bag 36 to be pinched or caught between the access door 48 and the sidewalls 52, 54, top wall 56 or bottom wall 58 in the handle canister assembly 12 is virtually eliminated. Accordingly, proper vacuum cleaner operation to the full capacity of the dust bag 36 is virtually assured. Further, proper seating of the access door 48 is virtually insured so that the cavity 34 is properly sealed. This prevents inadvertent pressure loss thereby insuring maximum cleaning efficiency.

In summary, numerous benefits result from employing the concepts of the present invention. A relatively simple and inexpensive structural arrangement is disclosed whereby the proper positioning of a dust bag 36 within the cavity 34 of a handle and nozzle assembly 12 is virtually assured. Specifically, retention flaps 62 are provided across the corners of the access opening defined by the sidewalls 52, 54 at their intersection with the top and bottom walls 56, 58. Advantageously, the retention flaps 62 may be molded from plastic as an integral portion of the handle and canister assembly. These retention flaps 62 function with the adjacent walls to define bag retention channels 64 that serve to hold the dust bag 36 in the desired position fully within the cavity 34 to allow interference free placement of the access door 48.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

What is claimed is:

1. A vacuum cleaner, comprising:

a nozzle assembly;

an agitator brush mounted for relative rotation on said nozzle assembly;

a motor and fan assembly carried on said vacuum cleaner; and a handle and canister assembly pivotally mounted to said nozzle assembly, said handle and canister assembly including a cavity for holding a dust bag, a removable access door for uncovering an access opening and allowing access to said cavity and a retention flap across a corner of said access opening for engaging and retaining said dust bag fully in said cavity when said access door is installed following dust bag replacement.

2. The vacuum cleaner of claim 1, wherein said handle and canister assembly includes two side walls, a bottom wall, a top wall and a back wall, one of said two side walls and one of said bottom or said top wall forming said corner of said access opening; said retention flap bridging between said one of said side walls and said one of said bottom or said top wall so as to form a bag retention channel with said one of said side walls, said one of said bottom wall or said top wall and said back wall.

3. The vacuum cleaner of claim 2, wherein said bag retention channel has a volume of at least 19,000 $mm^3$.

4. The vacuum cleaner of claim 2, wherein said bag retention channel has a volume between substantially 18,000–20,000 $mm^3$.

5. The vacuum cleaner of claim 4, wherein said two side walls, said bottom wall and said top wall define four said corners and four said retention flaps are provided with one said retention flap across each said corner.

6. The vacuum cleaner of claim 5, wherein said access opening defined between said two side walls, said bottom wall, said top wall and said retention flaps has an area of at least 72,000 $mm^2$.

7. The vacuum cleaner of claim 6, wherein each said retention flaps is triangular in shape.

8. A method of retaining a dust bag in the cavity of a handle and canister assembly of a vacuum cleaner, comprising:

providing said handle and canister assembly with an access opening in communication with said cavity; and extending retention flaps across corners of said access opening so as to define bag retention channels partially receiving and retaining said dust bag in said cavity as an access door is placed over said handle and canister assembly to close said access opening.

* * * * *